US007927043B2

(12) United States Patent
Iwasaki et al.

(10) Patent No.: US 7,927,043 B2
(45) Date of Patent: Apr. 19, 2011

(54) ROCKBOLTS MADE OF STEEL PIPES

(75) Inventors: Tatsurou Iwasaki, Fukuoka (JP); Masahiro Nakata, Tokyo (JP); Hiromichi Shiroma, Tokyo (JP); Tetsuo Itou, Tokyo (JP); Kenji Ooshima, Tokyo (JP); Hiroyuki Tanase, Mie (JP); Takefumi Nakako, Hyogo (JP); Takeyuki Yoshida, Hyogo (JP); Toshiharu Kittaka, Tokyo (JP)

(73) Assignee: Nisshin Steel Co., Ltd., Tokyo (JP)

( * ) Notice: Subject to any disclaimer, the term of this patent is extended or adjusted under 35 U.S.C. 154(b) by 0 days.

(21) Appl. No.: 10/579,318

(22) PCT Filed: Jul. 29, 2004

(86) PCT No.: PCT/JP2004/011200

§ 371 (c)(1),
(2), (4) Date: May 16, 2006

(87) PCT Pub. No.: WO2005/047648

PCT Pub. Date: May 26, 2005

(65) Prior Publication Data

US 2007/0081864 A1 Apr. 12, 2007

(30) Foreign Application Priority Data

Nov. 17, 2003 (JP) ..... 2003-387109

(51) Int. Cl.
*E21D 21/00* (2006.01)
*E21D 20/00* (2006.01)

(52) U.S. Cl. ..... 405/259.3

(58) Field of Classification Search ..... 411/82, 411/82.1, 930; 405/259.1, 259.5, 259.3
See application file for complete search history.

(56) References Cited

U.S. PATENT DOCUMENTS

| | | | | |
|---|---|---|---|---|
| 4,509,889 | A * | 4/1985 | Skogberg et al. | 411/19 |
| 4,511,289 | A * | 4/1985 | Herron | 405/259.3 |
| 4,634,317 | A * | 1/1987 | Skogberg et al. | 405/259.3 |
| 4,954,017 | A | 9/1990 | Davis et al. | |
| 6,428,243 | B1 * | 8/2002 | Hutchins | 405/259.1 |

FOREIGN PATENT DOCUMENTS

| | | | |
|---|---|---|---|
| DE | 10057041 | | 5/2002 |
| EP | 272233 | A1 * | 6/1988 |
| JP | 63-185900 | A | 11/1988 |

(Continued)

*Primary Examiner* — Sunil Singh
(74) *Attorney, Agent, or Firm* — The Webb Law Firm

(57) ABSTRACT

A sleeve 10 for introduction of a pressurized fluid, which is attached to a rockbolt main body 1, comprises a cylindrical projecting part 11 of a large diameter and a bearing-plate-holding part 12 of a diameter smaller than an aperture of a bearing plate 6. The projecting part 11 and the bearing-plate-holding part 12 preferably has the same inner diameter. When the rockbolt main body 1 is embedded in a bedrock or ground, the bearing plate 6 locates on an edge of a rockbolt-setting hole of the bedrock or ground, and the bearing-plate-holding part 12 extends through the bearing plate 6 into the rockbolt-setting hole. Since the projecting part 11 and the bearing plate 6 are disposed on a sprayed concrete layer, a projection height of the rockbolt is remarkably decreased. Consequently, lining concrete 8 is applied onto the sprayed concrete layer with ease, and the bedrock or ground is reinforced with high reliability.

6 Claims, 3 Drawing Sheets

FOREIGN PATENT DOCUMENTS

| | | | | |
|---|---|---|---|---|
| JP | 63185900 | | | 11/1988 |
| JP | 64-043700 | | | 2/1989 |
| JP | 64043700 | A | | 2/1989 |
| JP | 2-5238 | B | | 2/1990 |
| JP | 5777798 | A | | 2/1990 |
| JP | 07-189598 | | | 7/1995 |
| JP | 07189598 | A | | 7/1995 |
| JP | 2003-206698 | | | 7/2003 |
| JP | 2003206698 | A | * | 7/2003 |
| JP | 2004-019181 | | | 1/2004 |
| JP | 2004019181 | A | | 1/2004 |
| JP | 2005-076310 | | | 3/2005 |
| JP | 2005076310 | A | | 3/2005 |
| WO | PCT/JP2004/011200 | | | 11/2004 |

* cited by examiner (PRIOR ART)

ROCKBOLTS MADE OF STEEL PIPES

BACKGROUND OF THE INVENTION

1. Field of the Invention

The present invention relates to rockbolts made of steel pipes and, more particularly, to rockbolts to be expansively embedded in a bedrock or ground for reinforcement.

2. Description of Related Art

A bedrock or ground with fear of spring water or sudden fall is conventionally reinforced by embedding deformed bar type rockbolts therein. Recently, expansive rockbolts, which are hammered and expanded in a bedrock or ground, have been employed instead of the deformed bar type rockbolts.

A conventional expansive rockbolt is made of a deformed steel pipe, which has an expansive groove extending along its axial direction and a sealed top end, as disclosed in JP 2-5238 B. The expansive rockbolt is placed in a hole of a bedrock or ground, after a sleeve for introduction of a pressurized fluid is attached to a rear end of the rockbolt. Thereafter, a pressurized fluid is forcibly injected into the rockbolt through an opening formed at a side of the sleeve, so that the deformed steel pipe is expanded and pressed onto an inner wall of the hole. As a result, the bedrock or ground is reinforced by fixation of the expanded rockbolt. Expansive rockbolts, which have joints attached to sleeves for supply of a pressurized fluid, are also disclosed by JP 2003-206698 A and JP 2004-019181 A.

An expansive rockbolt provided with a joint for introduction of a pressurized fluid has a main body 1, to which a sleeve 2 for introduction of a pressurized fluid is attached at its rear end, as shown in FIG. 1. An opening 3 for injection of a pressurized fluid is formed at a side of the sleeve 2, and both sides of the opening 3 are shaped to a cylindrical part 4 for sealing with packing. A large diameter flare 5 is formed at an end of the cylindrical part 4 for enlargement of a surface area in contact with a bearing plate 6. Formation of the cylindrical part 4 and the flare 5 unavoidably put restrictions on a length of the sleeve 2, but the sleeve 2 can not be shorter than a predetermined length. As a result, the sleeve 2 projects from the bearing plate 6 higher than a conventional deformed bar type rockbolt, when the rockbolt main body 1 is set in a hole of a bedrock or ground.

By the way, in a construction site such as a tunnel, a bedrock or ground is drilled through a sprayed concrete layer for formation of a rockbolt-setting hole, a rockbolt is set in the hole, and then the rockbolt is hydraulically expanded for reinforcement of the bedrock or ground. Thereafter, the sprayed concrete layer is covered with a waterproof sheet 7, and lining concrete 8 is placed thereon, as shown in FIG. 2.

During placing the lining concrete 8, the waterproof sheet 7 often tears due to the projected sleeve 2. The lining concrete 8 becomes thinner at a part corresponding to the projected sleeve 2. The waterproof sheet 7 is prevented from tearing by attachment of a cap to the projected sleeve 2 in prior to covering with the waterproof sheet 7. However, attachment of the cap not only requires additional labor and time but also makes the lining concrete 8 thinner, resulting in poor strength. Moreover, if the lining concrete 8 is dislocated from the sprayed concrete layer due to thermal expansion and shrinkage, the lining concrete 8 is sometimes cracked 9 at a position near a top of the projected sleeve 2.

SUMMARY OF THE INVENTION

The present invention aims at provision of an expansive rockbolt, having a pressurized-fluid-introducing sleeve partially inserted in a rockbolt-setting hole of a bedrock or ground in order to decrease a height of the sleeve projecting from a sprayed concrete layer. Due to the decrease in the projection height, a lining concrete layer is prevented from thickness deviation and cracking, so that the bedrock or ground can be firmly reinforced with high reliability.

The expansive rockbolt proposed by the invention comprises a rockbolt main body and a sleeve for introduction of a pressurized fluid, which is fixed to the rockbolt main body at a side for supply of the pressurized fluid. The sleeve has a cylindrical projecting part and a bearing-plate-holding part. The cylindrical projecting part has an outer diameter larger than an aperture of a bearing plate and an opening for injection of the pressurized fluid. The bearing-plate-holding part has an outer diameter smaller than the aperture of the bearing plate. In the state that the rockbolt main body is placed in a rockbolt-setting hole of the bedrock or ground, the bearing plate locates on an edge of the rockbolt-setting hole, and the bearing-plate-holding part extends through the bearing plate into the rockbolt-setting hole. Consequently, the large-diameter part only projects from a sprayed concrete layer.

A groove is preferably formed on an outer surface of the large-diameter part along a circumferential direction. An opening (preferably having a diameter smaller than width of the groove) may be formed in the groove for injection of a pressurized fluid.

A corrosion-resistant coated steel pipe is suitable as material of the rockbolt, since a thick steel pipe is not necessarily used in order to compensate corrosion loss by thickness. The coated steel pipe has a Zn, Zn—Al or Zn—Al—Mg plating layer. The Zn—Al layer may be Zn-5% Al, Zn-55% Al or the like. Especially, a Zn—Al—Mg layer, which contains 0.05-10% of Mg and 4-22% of Al, is optimum for corrosion-resistance and durability of the rockbolt.

PREFERRED EMBODIMENTS OF THE INVENTION

The inventors have researched and examined various means for making a portion, which projects from a sprayed concrete layer when a rockbolt is placed in a rockbolt-setting hole of a bedrock or ground, as shorter as possible. The handiest mean is use of a short sleeve for introduction of a pressurized fluid, but the short sleeve causes other troubles. That is, since sleeves are attached and welded to both ends of a deformed steel pipe of an expansive rockbolt, mere shortening accelerates deformation of the sleeves at positions near welded joints during hydraulically expanding the a deformed steel pipe, resulting in breakdown of the sleeves and the deformed steel pipe due to an excess hydraulic pressure.

Figure 3A:
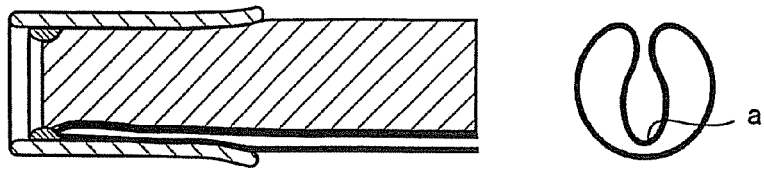
FIG. 3A is a sectional view of an unexpanded rockbolt.
Figure 3B:
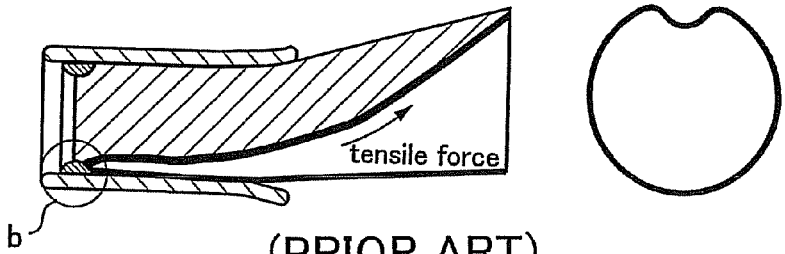
(PRIOR ART) FIG.3B
FIG. 3B is a sectional view of an expanded rockbolt.
Figure 4:
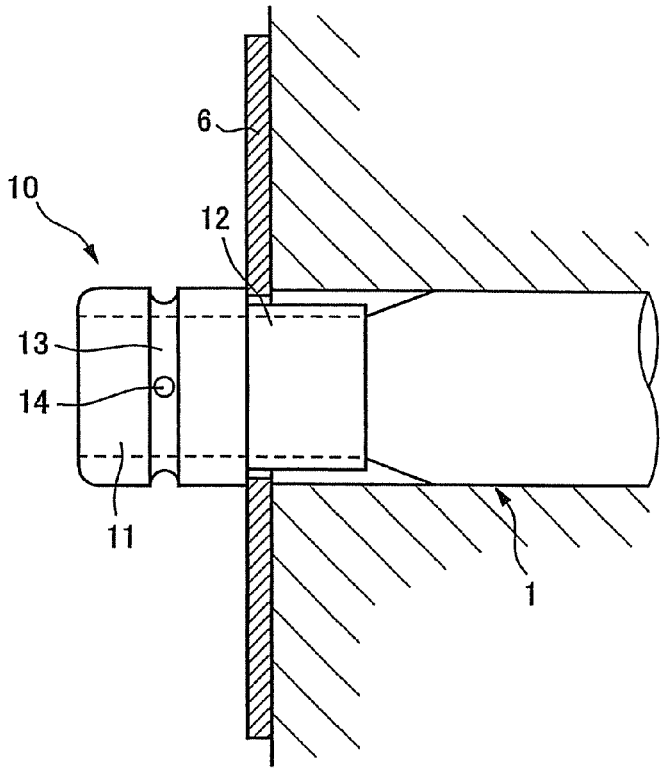
(PRIOR ART) FIG.4
FIG. 4 is a sectional view of an expansive rockbolt proposed by the present invention.

For instance, a bottom (a) of a dent is affected by a tensile stress, and a part near a welded joint (b) is often broken during expansion of a rockbolt from FIG. 3A to FIG. 3B. In order to suppress deformation of a sleeve at a position near the part (b) during hydraulic expansion, the sleeve shall have a certain length, which depends on material and weld strength of a deformed steel pipe. In this sense, mere shortening of the sleeve for suppression of a projecting height is not practical in respect that proper strength shall be guaranteed.

On the other hand, the inventive rockbolt has a pressurized-fluid-introducing sleeve with the structure that a large-diameter part and a small-diameter part are formed in series. The small-diameter part is inserted into a bearing plate and placed in a rockbolt-setting hole of a bedrock or ground. The large-diameter part only projects outwards from a sprayed concrete layer, so as to suppress a projection height.

Concretely, a pressurized-fluid-introducing sleeve 10 for introduction of a pressurized fluid comprises a cylindrical projecting part 11 and a bearing-plate-holding part 12. The projecting part 11 has an outer diameter larger than an aperture of a bearing plate 6, while the bearing-plate-holding part 12 has an outer diameter smaller than the aperture of the bearing plate 6. The projecting parts 11 preferably has the same inner diameter as the bearing-plate-holding part 12.

The projecting part 11 is preferably as shorter as possible for reducing its height projecting from a sprayed concrete layer. However, a lower limit of the height is determined for attachment of a pressurized fluid introducing joint 20 (shown in FIG. 5). A top of the projecting part 11 is preferably chamfered in order to inhibit tearing of a waterproof sheet 7, which is overlaid on the sprayed concrete layer and the secured rockbolt. Therefore, attachment of a protection cap to the sleeve 10 for prevention of the waterproof sheet 7 from tearing can be omitted, resulting in completion of construction in a shorter period with cost saving.

A longer bearing-plate-holding part 12 is mechanically stronger, but the effect of length on strength is definitive. If the bearing-plate-holding part 12 is too shorter on the contrary, it is occasionally broken at a part near a welded joint by affection of a hydraulic pressure, resulting in water leak. Therefore, a length of the bearing-plate-holding part 12 is preferably determined to a value from L/3 to L in relation with a length L of the projecting part 11.

The projecting part 11 and the bearing-plate-holding part 12 are formed by machining a pipe, which has an outer diameter equal to an outer diameter of the projecting part 11 and an inner diameter equal to an outer diameter of a rockbolt main body 1 at an end, to a profile corresponding to the projecting part 11 and the bearing-plate-holding part 12. These parts 11 and 12 are also individually formed from two pipes, which have the same inner diameter with thickness different from each other.

A groove 13 is formed on a surface of the projecting part 11 along a circumferential direction, and a hole 14 for introduction of a pressurized fluid is formed in the groove 13. A size of the hole 14 is made smaller than width of the groove 13; otherwise burrs, which are formed by drilling the hole 14, would extend from the groove 13 to a surface of the projecting part 11.

Due to combination of the projecting part 11 with the bearing-plate-holding part 12, the bearing plate 6 is telescoped onto the bearing-plate-holding part 12 and held at a step between the projecting part 11 and the bearing-plate-holding part 12. Namely, the bearing-plate-holding part 12 is placed through a sprayed concrete layer in a rockbolt-setting hole of a bedrock or ground, and the bearing plate 6 is located on an edge of the rockbolt-setting hole. Consequently, the projecting part 11 only projects outward from the sprayed concrete layer.

A rockbolt embedded in a bedrock or ground is exposed to a corrosive atmosphere. The atmosphere varies from acid to alkali in response to humidity, water quality, ventilation and so on. Accounting such an atmosphere, coated steel pipes, which have plating layers formed on inner and outer surfaces, are appropriate material for corrosion-resistant and durable rockbolts in the bedrock or ground. Such coated steel pipes are offered by a pre-coating or post-coating process, but pre-coated steel pipes, which are manufactured from coated steel sheets, are profitable in respect to productivity.

A plating layer may be Zn, Zn—Al or Zn—Al—Mg. A Zn plating layer is preferably formed on a steel base by immersing a steel strip in a hot-dip bath containing 0.1-0.2% Al, which suppresses growth of a Fe—Zn alloy layer harmful on workability. A Zn—Al plating layer, e.g. Zn-5% Al or Zn-55% Al, exhibits corrosion-resistance 2-4 times better than a Zn plating layer of the same thickness. A Zn—Al—Mg plating layer is hard and exhibits the optimum corrosion-resistance. When a rockbolt coated with the hard Zn—Al—Mg plating layer is placed and expanded in a bedrock or ground, it is prevented from scratching caused by abrasion with the bedrock or collision of scatters. Scratching is also inhibited during handling or transporting the coated rockbolt. Since scratches, which act as starting points of corrosion, scarcely occur, the embedded rockbolt maintains good durability and reliability in addition to the corrosion-resistant Zn—Al—Mg plating layer even in a corrosive environment.

The Zn—Al—Mg plating layer may be thinned to 3-30 μm due to excellent corrosion-resistance and hardness. The Zn—Al—Mg plating layer contains 0.05-10% Mg, 4-22% Al. It may further contain 0.001-0.1% Ti, 0.0005-0.045% B and/or 0.005-2.0% at least one of rare earth metals, Y, Zr and Si.

A component Mg is incorporated in a zincic corrosion product, which is formed on a surface of the plating layer. The Mg-containing zincic corrosion product together with a component Al in the plating layer reduces a corrosion rate of the plating layer in a soil environment. Since a part of the Mg-containing zincic corrosion product also flows into a weld bead and a cut edge in a process of manufacturing a pre-coating steel pipe, the weld bead and the cut edge are prevented from corrosion. Moreover, when a welded part is repaired by thermal spraying, the Mg-containing zincic corrosion product flows onto a sprayed layer or into a corrosion product on the sprayed layer, resulting in protection of a steel base from corrosion. The component Mg is also important for hardening the plating layer by formation of a Zn—Mg intermetallic compound. These effects are achieved by controlling a Mg content within a range of 0.05-10% (preferably 1-4%).

while Zn and Mg in the plating layer are converted to a Mg-containing zincic corrosion product, the other component Al is converted to a clinging Zn—Al corrosion product as a corrosion inhibitor. $Zn/Al/Zn_2Mg$ ternary eutectic grains appear in a solidified plating layer due to presence of Al. The ternary eutectic grains have a microstructure finer than $Zn/Zn_2Mg$ binary eutectic grains and raise hardness of the plating layer. An Al content of 4% or more is necessary for formation of the clinging Zn—Al corrosion product and the $Zn/Al/Zn_2Mg$ ternary eutectic grains. However, an increase of the Al content raises a melting temperature of a plating metal and needs holding a hot-dip bath at an elevated temperature, resulting in poor productivity. In this sense, an upper limit of the Al content is determined at 22%.

Optional elements Ti and B suppress formation of a $Zn_{11}Mg_2$ phase harmful on an external appearance of a coated steel sheet, so that Zn—Mg intermetallic compounds, which precipitate in a plating layer, are substantially composed of $Zn_2Mg$. The effect of Ti on inhibiting formation of the $Zn_{11}Mg_2$ phase is apparently noted by 0.001% or more (preferably 0.002% or more) of Ti. However, excess Ti above 0.1% promotes growth of a Ti—Al precipitate in the plating layer, resulting in a rugged surface of the plating layer with poor external appearance.

Formation of the $Zn_{11}Mg_2$ phase is also suppressed by addition of B at a ratio of 0.0005% or more (preferably 0.001% or more). But, excess B above 0.045% promotes growth of Ti—B and Al—B intermetallic compounds, which degrade a smooth surface and external appearance of a plating layer.

A rockbolt, which is formed from a steel pipe hot-dip coated with a Zn—Al—Mg plating layer containing Al and Mg at relatively large ratios, often reduces its surface gloss. Reduction of the surface gloss is typically noted in the Zn—Al—Mg plating layer, and a surface of the plating layer is gradually changed from a fine metallic luster to gray with the lapse of time. As a result, the rockbolt decreases its commercial value. Reduction of the surface gloss is prevented by adding at least one oxidizable element selected from the group consisting of rare earth metals, Y, Zr and Si at a ratio of 0.005% or more. However, a maximum ratio of the oxidizable element is determined at 2.0%, since its effect on reduction of the surface gloss can not be expected any more by excess addition above 2.0%.

Formation of a Fe—Al intermetallic compound at a boundary between a base steel and a plating layer is more accelerated as an increase of Al in the Zn—Al—Mg plating layer. The Fe—Al intermetallic compound causes peeling-off of the plating layer during working or forming a coated steel sheet or pipe. Formation of the Fe—Al intermetallic compound harmful on workability and formability is inhibited by inclusion of Si at a small ratio in the plating layer.

Figure 5:
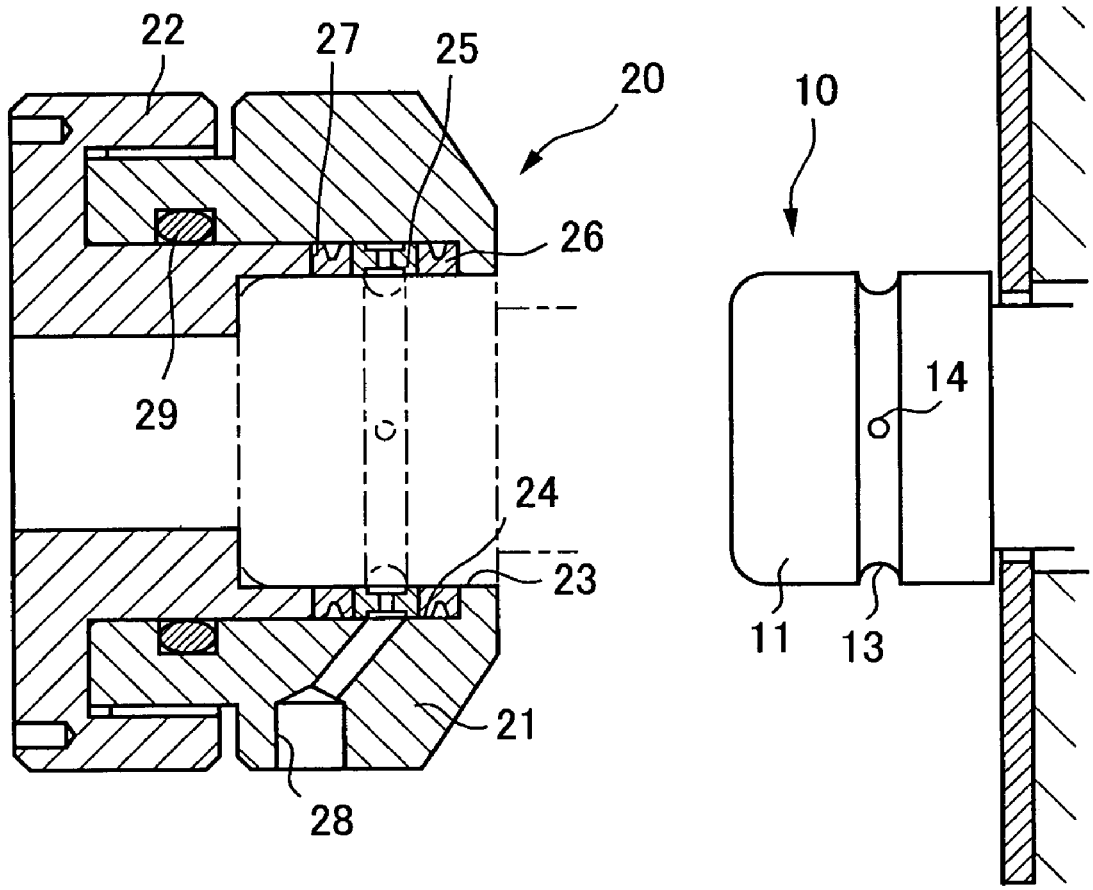
FIG. 5 is a view for explaining an example of a joint for introduction of a pressurized fluid.

A member for hydraulic expansion, which is attached to a projecting part 11 of a sleeve 10 for introduction of a pressurized fluid, may be a joint 20 with a guide ring 22 screwed into a bush 21, as shown in FIG. 5. The bush 21 has an opening 23 for insertion of the projecting part 11 and a concave 24 for fixing the projecting part 11 therein. Annular packings 26 and 27 are received in the concave 24, in the manner that an adapter ring 25 is hermetically sandwiched between the packings 26 and 27 at a position corresponding to an inlet 28 for introduction of a pressurized fluid. After an O-ring 29 is interposed between the guide ring 22 and the bush 21, the guide ring 22 is screwed into the bush 21. Since the projecting part 11 is inserted into the bush 21 through the opening 23 at one end and the guide ring 22 is screwed into the bush 21 from the other end, it is possible to shorten a distance from a top of the joint 20 to the annular packings 26, 27. Consequently, the sleeve 10 with the short projecting part 11 can be employed.

The inventive rockbolt is used for reinforcement of a bedrock or ground as follows:

A rockbolt-setting hole is drilled through a sprayed concrete layer in a bedrock or ground. After a bearing plate 6 is attached to a rockbolt main body 1, the rockbolt main body 1 is placed in the rockbolt-setting hole. In this state, the bearing plate 6 locates on an edge of the rock-bolt setting hole, and a bearing-plate-holding part 12 extends through an aperture of the bearing plate 6 into the rockbolt-setting hole. Since the bearing plate 6 is held in contact with a step between the projecting part 11 and the bearing-plate-holding part 12, a sleeve 10 is stationarily secured to the rockbolt main body 1.

The bush 21 of the joint 20 is telescoped onto the part 11, which projects from the sprayed concrete layer, until the packings 26, 27 are pressed onto a periphery of the projecting part 11. As a result, a sealed space is defined by an outer surface (including a groove 13) of the projecting part 11 and the adapter ring 25. The inlet 28 for introduction of a pressurized fluid is opened to the sealed space, and the sealed space is communicated through the hole 14 to an interior of the rockbolt main body 1. Therefore, the rockbolt main body 1, i.e. a deformed steel pipe, is hydraulically expanded and firmly fixed in the bedrock or ground by supplying a pressurized fluid through the inlet 28 into the rockbolt main body 1.

Fixation of the expanded rockbolt in the bedrock or ground is examined by a withdrawal test. The groove 13 is available for attachment of a collet chuck of a withdrawal tester, and the rockbolt is firmly gripped for measurement of a withdrawal resistance with a high reliability. A withdrawal tester proposed by JP Appl. No. 2003-308822 may be employed for the purpose.

Figure 1:
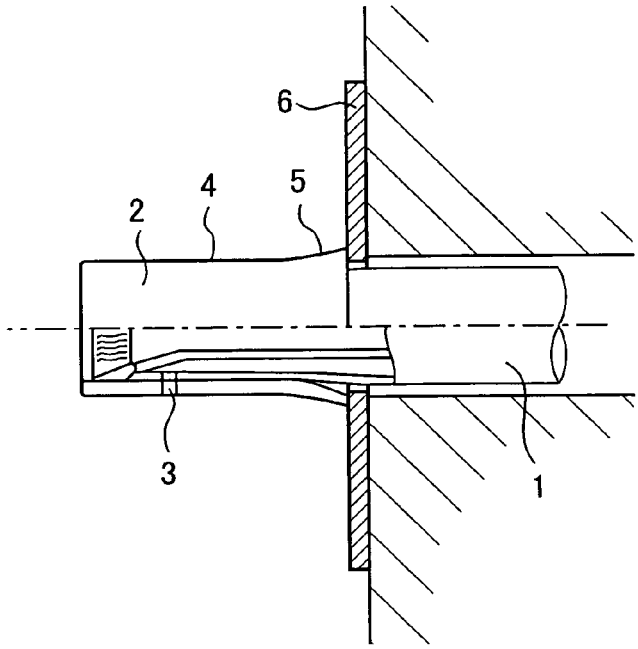
FIG. 1 is a schematic view of a conventional rockbolt, which is placed in a rockbolt-setting hole of a bedrock.
Figure 2:
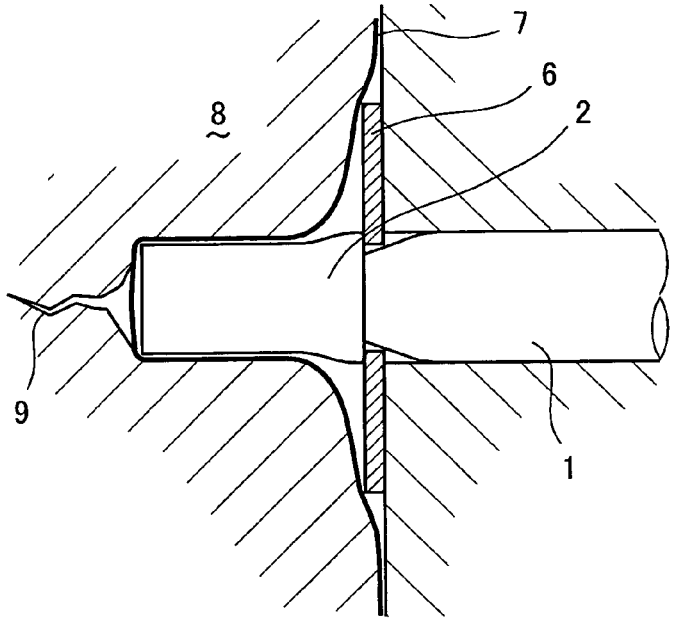
(PRIOR ART) FIG.2
FIG. 2 is an explanatory view for placement of lining concrete after hydraulic expansion of the conventional rockbolt.

After the withdrawal test, the large-diameter part 11, which projects outward from a sprayed concrete layer, is covered with a waterproof sheet 7, and lining concrete 8 is applied on to the sprayed concrete layer so as to enclose the projecting part 11, as shown in FIG. 2. Since a projection height of the rockbolt from the sprayed concrete layer is remarkably decreased, it is not necessary to attach a cap to the projecting part 11 of the rockbolt, and thickness deviation of the lining concrete 8 becomes smaller. Consequently, a bedrock or ground is easily reinforced with a high reliability without formation of cracks 9 in the lining concrete 8.

INDUSTRIAL APPLICABILITY

The expansive rockbolt proposed by the invention as above-mentioned has a sleeve 10 for introduction of a pressurized fluid, which comprises a cylindrical projecting part 11 of a large diameter and a bearing-plate-holding part 12 of a small diameter. The bearing-plate-holding part 12 is placed in a rockbolt-setting hole of a bedrock or ground, so that a projection height of the large-diameter part 11 from a sprayed concrete layer is remarkably decreased. As a result, lining concrete 8 is applied onto the sprayed concrete layer with less thickness deviation even at a position near the projecting part 11 of the rockbolt, and occurrence of cracks 9 in the lining concrete 8 and tearing of a waterproof sheet 7 are both inhibited due to the decrease of the projection height. Consequently, the bedrock or ground is easily reinforced with a high reliability.

The invention claimed is:

1. A steel pipe rockbolt, comprising a rockbolt main body and a pressurized-fluid-introducing sleeve fixed by welding to the rockbolt main body at an end for introduction of a pressurized fluid, wherein the rockbolt main body is a deformed pipe having an expansive groove extending along an axial direction of the deformed pipe, and wherein the rockbolt main body is configured to hydraulically expand upon the introduction of the pressurized fluid, the pressurized-fluid-introducing sleeve comprising a projecting part with an outer diameter larger than a diameter of an aperture of a bearing plate and a pressurized-fluid-introducing hole, and a bearing-plate-holding part with an outer diameter smaller than the diameter of the aperture of the bearing plate, the projecting part and the bearing-plate-holding part defining a passageway, a portion of the expansive groove of the rockbolt main body being positioned within the passageway, whereby the bearing plate is held in contact with a step between the projecting part and the bearing-plate-holding part, the projecting part and the bearing-plate-holding part having a single, one-piece unitary construction, the projecting part being fixed relative to the bearing-plate-holding part, whereby the bearing plate locates on an edge of a rockbolt-setting hole drilled in a bedrock or ground, and the bearing-plate-holding part extends through the aperture of the bearing plate into the rockbolt-setting hole, the projecting part and the bearing-plate-holding part being substantially rigid, the rockbolt main body configured to hydraulically expand relative to the projecting part and the bearing-plate-holding part to secure the rockbolt main body within the rockbolt-setting hole.

2. The steel pipe rockbolt as claimed in claim 1, wherein the projecting part has a groove formed on its outer surface along a circumferential direction.

3. The steel pipe rockbolt as claimed in claim 1, wherein the rockbolt main body is formed from a steel pipe coated with a Zn, Zn—Al or Zn—Al—Mg plating layer.

4. The steel pipe rockbolt as claimed in claim 1, wherein the rockbolt main body has a continuous outer surface defining a hollow cavity that is adapted to hydraulically expand upon the introduction of the pressurized fluid.

5. The steel pipe rockbolt as claimed claim 4, wherein the hollow cavity extends over an entire length of the rockbolt main body.

6. The steel pipe rockbolt as claimed in claim 1, wherein the passageway has a constant diameter.

* * * * *